US007270629B1

(12) United States Patent
Kramer

(10) Patent No.: US 7,270,629 B1
(45) Date of Patent: Sep. 18, 2007

(54) EXERCISE DEVICE FOR TONING HORSEBACK RIDING MUSCLES AND ASSOCIATED METHODS

(76) Inventor: Hyde Kramer, HC 75 Box 15, Seneca, NE (US) 69161

( * ) Notice: Subject to any disclaimer, the term of this patent is extended or adjusted under 35 U.S.C. 154(b) by 0 days.

(21) Appl. No.: 11/215,396

(22) Filed: Aug. 30, 2005

Related U.S. Application Data

(60) Provisional application No. 60/616,005, filed on Oct. 5, 2004.

(51) Int. Cl.
*A63B 21/068* (2006.01)
*A63B 21/00* (2006.01)

(52) U.S. Cl. ..... 482/95; 482/92; 482/131; 482/140

(58) Field of Classification Search ..... 482/51, 482/72, 92, 95, 96, 140, 907, 122, 128, 131; D21/687; 472/95, 106, 108
See application file for complete search history.

(56) References Cited

U.S. PATENT DOCUMENTS

| | | | | |
|---|---|---|---|---|
| 2,884,247 | A | 4/1959 | Johns | |
| D209,759 | S | 1/1968 | Snyder | |
| D214,569 | S | 7/1969 | Kusznir | |
| 3,850,430 | A | 11/1974 | Hamilton | |
| 4,116,434 | A | 9/1978 | Bernstein | |
| D292,427 | S | 10/1987 | Baburek | |
| 4,909,506 | A | 3/1990 | Smith | |
| 4,979,737 | A | 12/1990 | Kock | |
| 5,178,599 | A * | 1/1993 | Scott | 482/137 |
| 5,458,553 | A * | 10/1995 | Wu | 482/95 |
| 5,470,295 | A * | 11/1995 | Wang | 482/71 |
| 5,643,147 | A | 7/1997 | Huang | |
| 5,643,150 | A | 7/1997 | Lee | |
| 5,674,163 | A | 10/1997 | Sennett | |
| 5,702,334 | A * | 12/1997 | Lee | 482/140 |
| 5,746,688 | A | 5/1998 | Prager | |
| 5,871,425 | A | 2/1999 | Gvoich | |
| 6,027,434 | A | 2/2000 | Gibbons | |
| 6,048,293 | A | 4/2000 | Lee | |
| 6,168,557 | B1 * | 1/2001 | Liao | 482/140 |
| 6,416,448 | B1 | 7/2002 | Hassler | |
| 6,814,690 | B1 * | 11/2004 | Stearns | 482/52 |
| 2003/0176263 | A1 | 9/2003 | Parmater | |
| 2005/0101443 | A1 * | 5/2005 | Liao | 482/51 |
| 2006/0052225 | A1 * | 3/2006 | Stearns | 482/140 |

* cited by examiner

*Primary Examiner*—Stephen R. Crow
*Assistant Examiner*—Allana Lewin
(74) *Attorney, Agent, or Firm*—Allen, Dyer, Doppelt, Milbrath & Gilchrist, P.A.

(57) ABSTRACT

An exercise device for strengthening muscles used in horseback riding includes a handle and a base having opposed surfaces. An elongated arm has a joint between a first and a second section. The first section is affixed to the handle at an outer end, and the second section is affixed to the base at an outer end. The joint permits angular movement between the first and the second section in a plane generally parallel to planes defined by the base surfaces. The first and the second section are bendable between a first and a more-acute second angle. In use, a user lies substantially prone and grasps the handle, places one heel against each of the base surfaces, and draws the base toward his/her trunk using heel pressure, thereby bending the arm from the first angle to the second angle.

10 Claims, 2 Drawing Sheets

EXERCISE DEVICE FOR TONING HORSEBACK RIDING MUSCLES AND ASSOCIATED METHODS

CROSS-REFERENCE TO RELATED APPLICATION

This application claims priority to provisional application Ser. No. 60/616,005, filed Oct. 5, 2004, entitled "Exercise Device for Toning Horseback Riding Muscles and Associated Methods," the disclosure of which is incorporated by reference hereinto.

BACKGROUND OF THE INVENTION

1. Field of the Invention

This invention relates to exercise devices, more particularly, to leg strengthening exercise devices, and most particularly, to exercise devices directed to the strengthening of muscles used in horseback riding.

2. Related Art

Various exercise devices are known in the art for targeting particular muscle groups. However, none is known that particularly is directed to the development of muscles used in the sport of bareback riding, particularly in rodeo competitions.

SUMMARY OF THE INVENTION

The present invention is directed to an exercise device for strengthening muscles used in horseback riding. The device comprises a handle and a base having opposed outer surfaces. An elongated arm has a joint between a first section and a second section. The first section is affixed to the handle at an outer end, and the second section is affixed to the base at an outer end. The joint is adapted to permit angular movement between the first and the second section in a plane generally parallel to planes defined by the base surfaces. The first and the second section are bendable between a first angle and a second angle less than the first angle.

In use, a user lies substantially prone and grasps the handle with at least one hand. The user then places one heel against each of the base surfaces, and draws the base toward his/her trunk using heel pressure, thereby bending the arm from the first angle to the second angle.

DETAILED DESCRIPTION OF THE PREFERRED EMBODIMENTS

Figure 1:
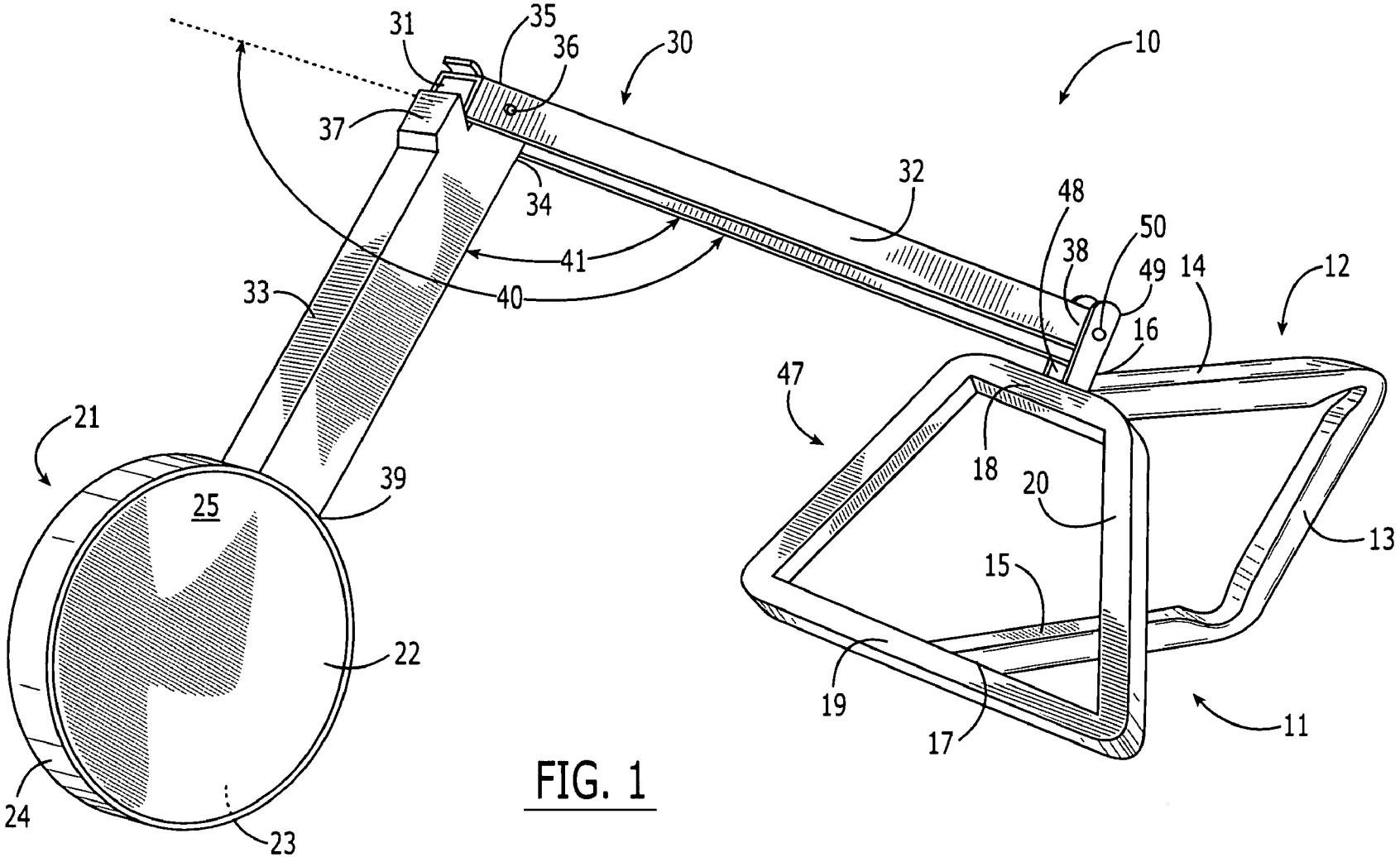
FIG. 1 is a side perspective view of the exercise device of the present invention in the second position.
Figure 2:
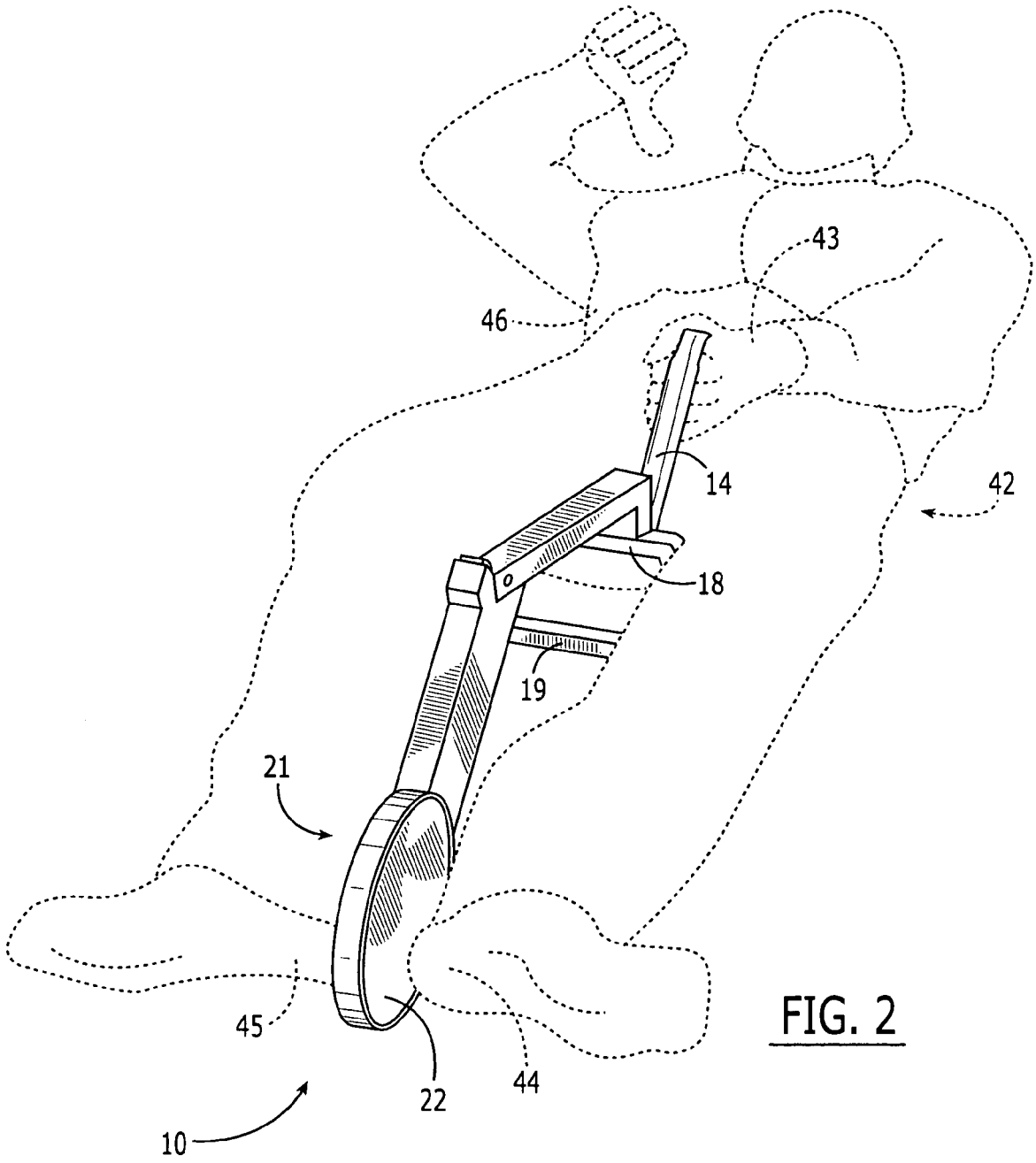
FIG. 2 is top-rear plan view of a user with the device in the first position.

A preferred embodiment of the present invention will now be discussed with reference to FIGS. 1 and 2.

The exercise device 10 is, in a particular embodiment, useful for strengthening muscles required in horseback riding, and, particularly, for muscles required in bareback rodeo riding. The device 10 comprises a handle 11 that preferably resembles an actual bareback rigging and lever system. The handle 11 comprises a gripping portion 12 that includes, for example, tubing that is formed into the shape of three sides of a parallelogram, a central section 13 adapted for grasping by the user. In use, the gripping portion

12 defines a generally vertical plane. A top 14 and a bottom 15 section are rigidly affixed at their ends 16,17 in substantially perpendicular fashion to a top 18 and a bottom 19 of a generally trapezoidal frame 47, a plane of the frame 47 generally normal to the gripping portion 12 plane.

Extending away from the frame 47, substantially perpendicular to the frame's top 18, is a joining arm 48, which comprises a pair of opposed elongated plates, each having a hole 49 adjacent their distal ends 50.

In a particular embodiment, the elements of the handle 11 comprise metal tubing, for example, ½-in. round metal tubing. Exemplary length dimensions comprise, for the gripping portion central section 13, 6 in.; for the gripping portion top 14 and bottom 15 sections, 7.5 in.; for the frame top 18, 5 in.; for the frame bottom 19, 12.5 in.; and for the frame sides 20, 7 in. The handle 11 has been designed specifically to simulate an actual bareback rigging and lever system. The handle 11 has also been designed at an angle to simulate the position and point of balance a bareback rigging has on a horse.

The device 10 also comprises a base 21 having opposed surfaces 22,23. In a particular embodiment, not intended as a limitation, the base 21 comprises a generally support structure comprising a generally disclike structure, which in turn comprises a metal ring 24 affixed in circumferential relation to a disc comprising a compressible pad 25. In an exemplary embodiment, the metal ring 24 has a ¾%-in. thickness and is 6 in. in diameter, and the pad 25 comprises a ¾-in.-thick rubber pad. The pad 25 can be affixed to the ring 24, for example, by a plurality of screws.

The device 10 also includes an elongated arm 30 that has a joint 31 between a first section 32 and a second section 33. In an exemplary embodiment, the first 32 and the second 33 sections are separate elements joined at their inner ends 34,35 by a pivotable joining element 36, although this is not intended as a limitation. Exemplary dimensions include lengths for the elements of 15 in. for the first section 32 and 8 in. for the second section 33. Exemplary materials include 1.25-in. square metal tubing for the first section 32 and 1 in. square metal tubing for the second section 33. An exemplary joining element 36 comprises a 14-in. bolt having a block or protrusion 37 extending therefrom to limit the range of extension between the first 32 and the second 33 sections.

The first section 32 is affixed to the joining arm 48 adjacent an outer end 38 by, for example, a ¼-in. pin and key through holes 50 in the joining arm 48 and a corresponding hole (not shown) in the first section 32, to form a hinge. Other mechanisms for forming a hinge will be apparent to one of skill in the art, and this device is not intended as a limitation.

The second section 33 is rigidly affixed to the base 21 at an outer end 39, for example, by welding. The joint 31 is adapted to permit angular movement between the first 32 and the second 33 section in a plane generally parallel to planes defined by the base surfaces 22,23. The first 32 and the second 33 section are bendable between a first angle 40 and a second angle 41 (shown by a dotted line in FIG. 1) more acute than the first angle 40.

In use, a user 42 lies substantially prone (FIG. 2) and grasps the gripping portion central section 13 with at least one hand 43. The base 21 is positioned substantially perpendicular to the surface on which the user is lying. The user 42 then places one heel 44,45 against each of the base surfaces 22,23, and lifts and draws the base 21 toward his/her trunk 46 using heel pressure, thereby bending the first 32 and the second 33 sections from the first angle 40 to the second angle 41, and then reversing the movement.

The device 10 of the present invention has been shown to be useful in exercising and building muscles used by a bareback rider in the sport of rodeo, as it simulates the feel of riding a horse bareback and improves the placement and control of feet.

What is claimed is:

1. An exercise device directed to toning muscles used in horseback riding comprising:

a handle comprising:

a gripping portion having a top and a bottom section joined by a central section, the top, the bottom, and the central section lying substantially in a generally vertical plane; and a frame affixed to outer ends of the top and the bottom handle sections in generally perpendicular fashion to the gripping portion, the frame generally vertical, the frame comprising a generally trapezoidal element having a top and a bottom section meeting at outer ends two opposed frame sides, the top section shorter than the bottom section, the outer ends of the top and the bottom handle sections affixed to the top and bottom frame sections, respectively, generally centrally therealong;

a base having opposed outer surfaces; and an elongated arm having a first section, a second section, and a joint between inner ends thereof, the first section affixed to the handle at an outer end, the second section affixed to the base at an outer end, the joint adapted to permit angular movement between the first and the second section in a plane generally parallel to planes defined by the base surfaces, the first and the second section bendable between a first angle and a second angle less than the first angle, the base drawable toward a trunk of the user by application of heel pressure against the base surfaces to bend the arm from the first angle to the second angle.

2. The exercise device recited in claim 1, wherein the top and the bottom sections and the frame sides have a generally tubular shape.

3. The exercise device recited in claim 1, wherein the base comprises an element having generally parallel planar outer surfaces.

4. The exercise device recited in claim 3, wherein the base comprises an outer, substantially rigid, support structure having a hole therein and a compressible pad affixed to the support structure in covering relation to the hole.

5. The exercise device recited in claim 4, wherein the support structure is generally circular.

6. The exercise device recited in claim 1, wherein the arm further comprises a limiting element positioned adjacent the joint, operable to restrict the second angle to a predetermined maximum angle.

7. The exercise device recited in claim 6, wherein the predetermined maximum angle comprises approximately 180 degrees.

8. The exercise device recited in claim 6, wherein the limiting element comprises a protrusion extending generally upwardly from the second section adjacent the inner end thereof, dimensioned and positioned to abut the first section inner end when the predetermined maximum angle is reached.

9. A method of toning muscles used in horseback riding comprising the steps of:

grasping a handle of an exercise device directed to toning muscles used in horseback riding by gripping a gripping portion of the handle having a top and a bottom section joined by a central section, the top, the bottom, and the central section lying substantially in a generally vertical plane, the handle comprising a frame affixed to outer ends of the top and the bottom handle sections in generally perpendicular fashion to the gripping portion, the frame generally vertical, the frame comprising a generally trapezoidal element having a top and a bottom section meeting at outer ends two opposed frame sides, the top section shorter than the bottom section, the outer ends of the top and the bottom handle sections affixed to the top and bottom frame sections, respectively, generally centrally therealong;

placing a heel on each of opposed outer surfaces of a base, the base connected to the handle by an elongated arm having a first section, a second section, and a joint between inner ends thereof, the first section affixed to the handle at an outer end, the second section affixed to the base at an outer end, the joint adapted to permit angular movement between the first and the second section in a plane generally parallel to planes defined by the base surfaces, the first and the second section bendable between a first angle and a second angle less than the first angle; and drawing the base toward a trunk of the user by application of heel pressure against the base surfaces to bend the arm from the first angle to the second angle.

10. The method recited in claim 9, wherein the heel-placing step comprises positioning each heel against a compressible portion of the base, and the drawing step comprises compressing the compressible base portion with sufficient pressure to effect movement of the base commensurate with movement of the heels.

* * * * *